US011041701B1

(12) United States Patent
Moy et al.

(10) Patent No.: US 11,041,701 B1
(45) Date of Patent: Jun. 22, 2021

(54) COMBUSTIBLE MUNITION CASE WITH CELL CAVITIES

(71) Applicant: U.S. Government as Represented by the Secretary of the Army, Dover, NJ (US)

(72) Inventors: Leon Moy, Verona, NJ (US); Viral Panchal, Parlin, NJ (US); Pasquale Carlucci, Fair Lawn, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/502,159

(22) Filed: Jul. 3, 2019

(51) Int. Cl.
*F42B 5/18* (2006.01)

(52) U.S. Cl.
CPC ..... *F42B 5/18* (2013.01)

(58) Field of Classification Search
CPC .. F42B 5/045; F42B 5/18; F42B 5/181; F42B 5/182; F42B 5/184; F42B 5/192; F42B 5/38
USPC ..... 102/431, 433, 434, 443, 700
See application file for complete search history.

(56) References Cited

U.S. PATENT DOCUMENTS 1,920,075 A * 7/1933 Haenichen ..... F42B 5/16 102/443
3,183,665 A * 5/1965 Webb ..... F02K 9/14 60/254
3,696,748 A * 10/1972 Picard ..... F41A 21/12 102/431
3,823,668 A * 7/1974 Remaly ..... F42B 5/184 102/433
3,828,676 A * 8/1974 Junker ..... F42B 3/04 102/530
3,901,153 A * 8/1975 Brabets ..... F42B 5/184 102/433
4,907,510 A * 3/1990 Martwick ..... F42B 5/045 102/434
5,063,851 A * 11/1991 Moscrip ..... F42B 5/045 102/433
5,160,804 A * 11/1992 Wahner ..... F42B 5/16 102/443
5,353,710 A * 10/1994 Eches ..... F42B 5/08 102/202
5,672,842 A * 9/1997 Brion ..... F42B 5/38 102/282
5,698,811 A * 12/1997 Pfersmann ..... F42B 5/38 102/202

(Continued)

FOREIGN PATENT DOCUMENTS

DE 3927400 A1 * 2/1991 ..... F42B 5/192

*Primary Examiner* — Stephen Johnson
*Assistant Examiner* — Benjamin S Gomberg
(74) *Attorney, Agent, or Firm* — John P. DiScala

(57) ABSTRACT

The present invention is directed to composite munition cases that burn without significant residue, rugged enough to withstand rough handling, and provides for additional burn rate control over current state of the art metal and combustible munition cases. The munition cases disclose herein utilizes combustible composite materials having an inner and outer walls connected by support structures. The support structures can be radial walls or honeycomb shaped cells. In another embodiment wedge elements assembled into a cylindrical munition case is also proposed. Exemplary composite materials include felted fiber, foam celluloid and polystyrene.

3 Claims, 5 Drawing Sheets

(56) References Cited

U.S. PATENT DOCUMENTS 8,696,838 B1 * 4/2014 Faridi ..... C06B 25/20
149/109.2

* cited by examiner

FIG. 1a
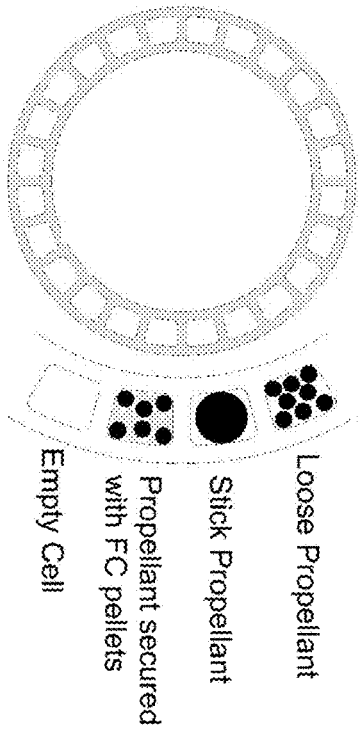
FIG. 1b
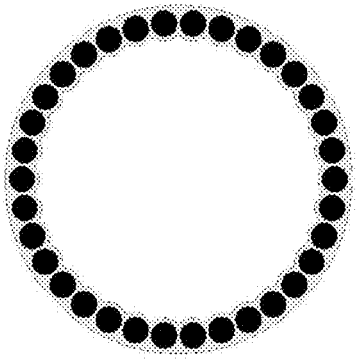
FIG. 1c
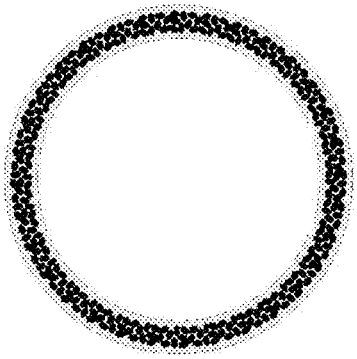
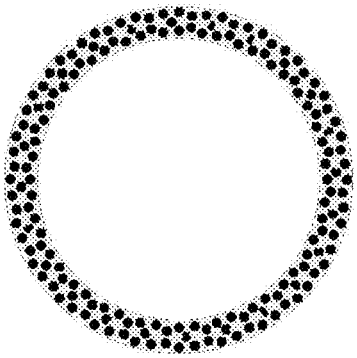
FIG. 1d

COMBUSTIBLE MUNITION CASE WITH CELL CAVITIES

RIGHTS OF THE GOVERNMENT

The inventions described herein may be manufactured and used by or for the United States Government for government purposes without payment of any royalties.

FIELD OF INVENTION

The present invention is generally directed to munition casing and more specifically to munition casing comprised of combustible material having structural support elements where the support elements have cell cavities for placement of propellants.

BACKGROUND OF THE INVENTION

Munition cartridge cases are typically made of metal, making the munition heavy and difficult to use and handle. Composite materials made from felted fiber have been used as a replacement for the metal in munition cartridge cases. These composite materials are lighter and combustible but, they offer less durability against environmental forces and physical handling. To compensate for these drawbacks, the composite casing walls are thicker than metal cases, which are generally tapered having the thinnest section at about 0.059 inches in wall thickness for tank casing and about 0.041 inches in wall thickness for the 105 mm artillery casing. The thicker walls however, reduces the amount of space available to house the propellants inside.

The present invention addresses the requirements for a combustible munition cartridge case that is lightweight, combustible, and rugged enough to resist rough handling and environmental forces as well as providing sufficient volume to house propellant inside the casing.

SUMMARY OF THE INVENTION

It is an object of the invention is provide a combustible munition case that burns without significant residue yet sufficiently rugged to withstand rough handling and transportation.

In one aspect of the invention, a composite rigid cylindrical munition cartridge case is provided having a longitudinal axis, a central hollow core, an inner cylindrical wall and an outer cylindrical wall. The inner and outer cylindrical walls are connected to each other by radial walls. The radial walls are perpendicular to the longitudinal axis. The radial walls along with the inner and outer cylindrical walls form a plurality of hollow longitudinal cavities. The composite rigid cylindrical munition cartridge case is composed of a combustible or consumable material. Such combustible material can be either felted fiber or foamed celluloid. Consumable material such as polystyrene may also be used. Propellants may be placed in the hollow longitudinal cavities to provide support for the walls and to modify the burn rates of the propellant associated with the munition casing.

In another aspect of the invention, a composite rigid cylindrical munition case is provided having a longitudinal axis and a central hollow core, a plurality of wedge sections, wherein each wedge section is comprised of a longitudinal cavity, said longitudinal cavity is surrounded by a parallel set of walls and a non-parallel set of walls wherein the walls run the entire length of the wedge section, and wherein the parallel set of walls run parallel to each other and form the outer and inner wall portions of the munition case and the non-parallel set of walls are perpendicular to the longitudinal axis, and wherein the wedge sections are comprised of a combustible or consumable material. The rigid cylindrical munition case can be made up of felted fiber, foamed celluloid, or polystyrene. Propellants may be placed inside the longitudinal cavity to provide support for the wall or aid in the burn rate of the propellant associated with the munition case.

In yet another aspect of the invention, a cylindrical munition case is provided having a longitudinal axis, a central hollow core, a cylindrical outer wall, a cylindrical inner wall that encircles a central hollow core and a plurality of honeycomb shape cells situated between the cylindrical inner wall and cylindrical outer wall, and wherein the rigid cylindrical munition case is comprised of a combustible or consumable material.

BRIEF DESCRIPTION OF THE DRAWINGS

Further features and advantages of the present invention may be understood from the drawings.

FIG. 1*a*. An illustration of various types of propellants that can be included into the hollow longitudinal walls of a combustible munition case.

FIG. 1*b*. An illustration of a stick propellant that can be inserted into the longitudinal walls.

FIG. 1*c*. An illustration of grains of propellant that can be inserted into the longitudinal walls.

FIG. 1*d*. An illustration of mixed propellants that can be inserted into the longitudinal walls.

DETAILED DESCRIPTION

Figure 2A:
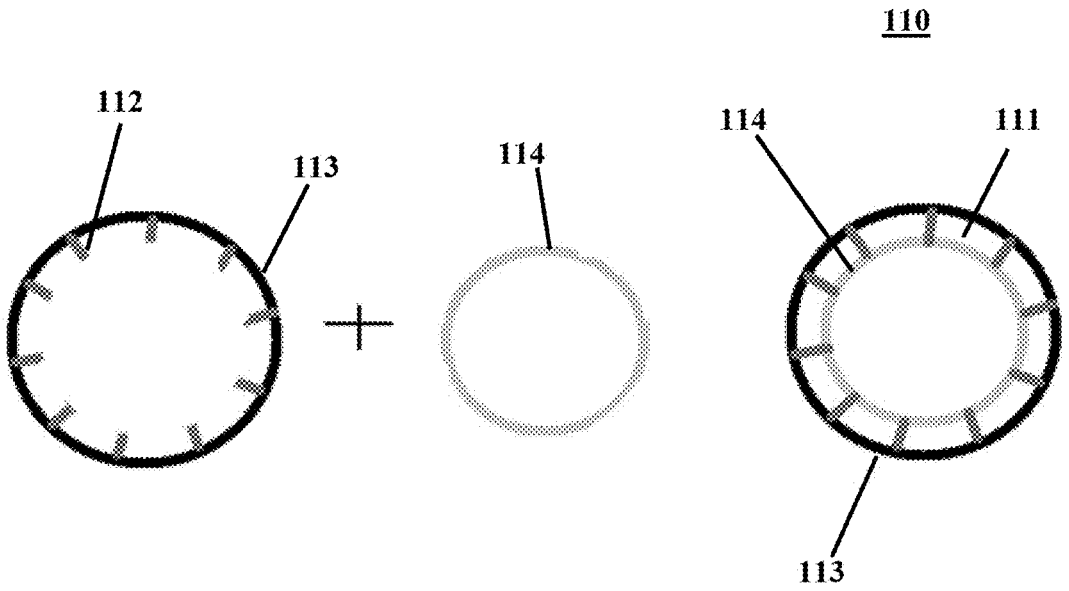
FIG. 2*a*. Is a cross-section view of one way a combustible munition cartridge case, comprised of an outer wall having radial walls that run longitudinal to the longitudinal axis and an inner wall, can be assembled.

Disclosed herein is a composite cartridge case having cell cavities for use in munitions. The cartridge case may be composed of a combustible material such that when the munition is ignited and burned, the material comprising the cartridge case is substantially consumed with little or no residue. The design disclosed herein further provides the combustible casing with greater resistance to bending forces as well as being capable of receiving propellants comparable to the volume placed inside metal cases. Such a design is an improvement over the current state of the art combustible cartridge using felted fiber. Additionally, the composite casing is an improvement over standard metal tank and artillery casing in that the composite material is lighter and burns upon combustion. Although the composite casing of the present invention may be about 2-3 times thicker than the standard metal casings, because of its structural configuration, it contains the same propulsion energy as compared to metal casings. In addition, it can house the same volume of propellant compared to a standard composite cartridge case.

The combustible cartridge case of the present invention utilizes a combination of two design features; a combustible cartridge case configured with a matrix of cell cavities where the cavities are available to receive propellants that further aid in the functionality of an inner wall and outer wall. The matrix of cell cavities can be configured either longitudinal to the length of the cartridge case or perpendicular to the length of the cartridge case.

Composite materials such as felted fiber or foamed celluloid are recommended for use with the cases disclosed herein. Use of such materials will ensure that the cartridge case is capable of being substantially consume during combustion of the munition. Other composite materials such as polystyrene may also be used. An optional protective coating may be applied to the surface of the cartridge case to protection against the elements.

Various processes can be utilized to make the composite munition case. Such methods include but are not limited to compression molding, bead molding, foam molding, injection molding, insert molding, extrusion, co-extrusion, vacuum molding, vacuum bagging, or 3D printing.

As an example, the combustible munition case can be made using a nitrocellulose-based material such as foam celluloid. Foam celluloid has good processing characteristics for this design as it can be processed like polystyrene foam, either as pellets or molded prior to foaming. Using celluloid pellets has the advantage that as it expands, it can entrap propellant grains in place, creating a rigid structure inside the cavity to provide additional strength. The process starts with a mold design having cylindrical cavity. Optional structural elements such as ribs (radial walls that run the length of the munition cartridge case) may be incorporated into the mold or separately molded and assembled together with the cylinder to form the munition casing. The mold can be made of aluminum, but is not limited to this type of metal only. The mold assembly may consists of an outer and an inner cavity to form the desired geometry.

Figure 2B:
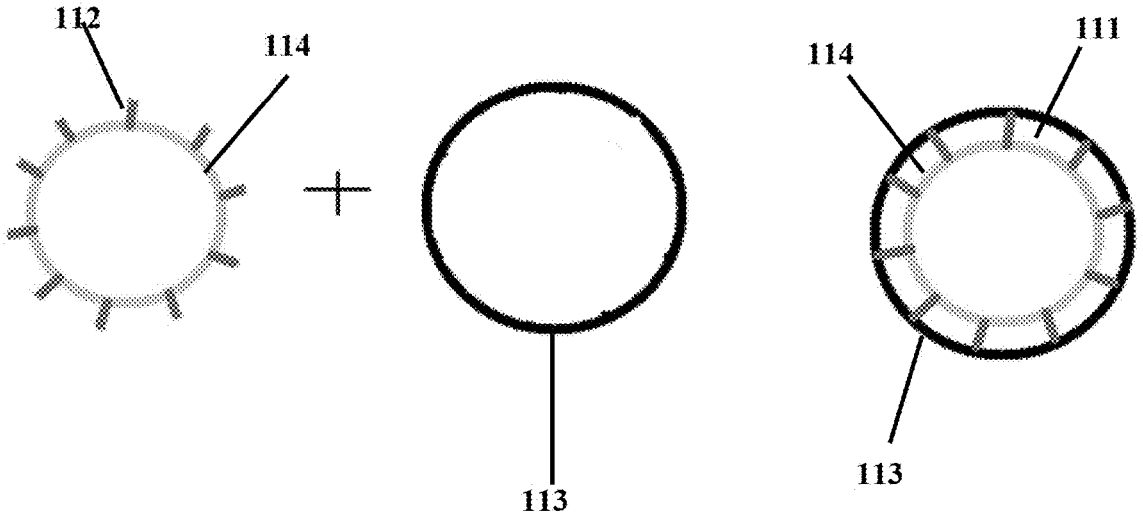
FIG. 2*b*. Is a cross-section view of another way a combustible munition cartridge case, comprised of an inner wall having radial walls that run longitudinal to the longitudinal axis and an outer wall, can be assembled.

The process for preparing a munition case starts by soaking dry celluloid pellets at −50° F. to +150° F., preferably around +70° F. with physical blowing agents (PBA), such as nitrogen, carbon dioxide or argon gases, between 40-10,000 psi, preferably around 400-600 psi for a period of from 10 mins to 24 hours. The presoaked beads are then transferred to the mold assembly. The mold is heated between 220° F. to 280° F. for a period of 10-60 seconds using water, steam, hot air, or oil etc. as heating media. During the 10-60 seconds processing time, foaming of celluloid beads occur within the mold cavity allowing the pellets to fuse/bond firmly to each other to form a rigid structure. The product is removed upon de-molding the assembly. Finishing steps (such as machining) are performed on an as needed basis. If multiple parts are made to fit together, the individual parts can then be assembled together using epoxy, glue or mechanical lock. FIGS. 2*a* and 2*b* illustrates how multiple components of a cartridge case can be combined into a single structure.

Alternatively, if the material has good melt properties (with high melt flow index (MFI)) and characteristics to heat and cool quickly, then all three parts of the cartridge case (e.g. the outer cylinder, wedges and inner cylinder) can be molded in a one-step process using injection molding or transfer molding. This can be achieved by continuously feeding celluloid pellets in the injection molding (or transfer molding) machine using a controlled gravimetric feeder. The solid bead material is heated gradually from room temperature to around 220° F. to around 260° F. The material continues to melt and slowly moved forward by a screw-type plunger along the length of the barrel. A physical blowing agent (PBA), such as nitrogen, carbon dioxide or argon gases, is injected into the melted mixture, allowing the gas to homogenously mix with the melt. The melted mixture is forced/injected through a nozzle at a certain rate, allowing the material to flow into the mold cavity. The mold remains cold (or is cooled after injection) for the melted mixture to solidify into a final geometry. Finishing steps are performed as needed. The final end product would be assembled as a homogenous piece.

It is contemplated that the combustible cartridge case may be utilized in conjunction with propellants to add structural strength to the walls, or assist with propelling the projectile housed in the cartridge. In addition, the propellant can be arranged inside the casing cavities to control flame spread and regulate burn rate. For example, when the propellant within the inner core is ignited, the inner wall could delay the ignition of the fast burning propellant within the longitudinal cell cavity. This would allow for the pressure profile to be tailored. Various types of propellant as illustrated in FIG. 1*b* to FIG. 1*d* may be placed into the longitudinal cell cavities. Such propellants can be in the form of solid sticks placed into the cavities (FIG. 1*b*), or grains of propellant between the walls that take on the shape of the cavity (FIG. 1*c*), or pellets mixed with grains of propellant (FIG. 1*d*). Use of adhesives or bonding agents such as epoxy can be used to secure the propellants inside the cavities.

Alternatively, the munition casing may be fabricated in-conjunction with the propellant being inside the wall by mixing the propellant with the combustible material (such as celluloid bead technology) during molding process. The expandable combustible material may secure the propellant in place, allowing it to contribute to the strength of the case and to fill the free volume.

Exemplary designs are illustrated in the examples below.

Example 1. Cartridge Case Comprised of Longitudinal Cells Cavities

FIGS. 2*a* and 2*b* illustrates a cross-sectional representation of a munition case 110 having longitudinal cell cavities where the radial walls 112 (i.e. ribs) are integrated as a single piece (by molding or 3D printing) with either the inner or outer wall of the casing. The longitudinal cell cavities 111 are formed by the intersection of radial walls 112 that connect the inner wall 114 and outer wall 113. The resulting longitudinal cell cavities 111 are created by molding the radial walls 112 with outer wall 113 (FIG. 2*a*) as a single piece and assembling it together with the inner wall 114 to form the munition case. Alternatively, the radial wall can be molded with the inner wall 114 as a single piece (FIG. 2*b*) and assembled with the outer wall 113 to form the munition case.

Example 2. Cartridge Case Comprised of Wedge Sections

Figure 3:
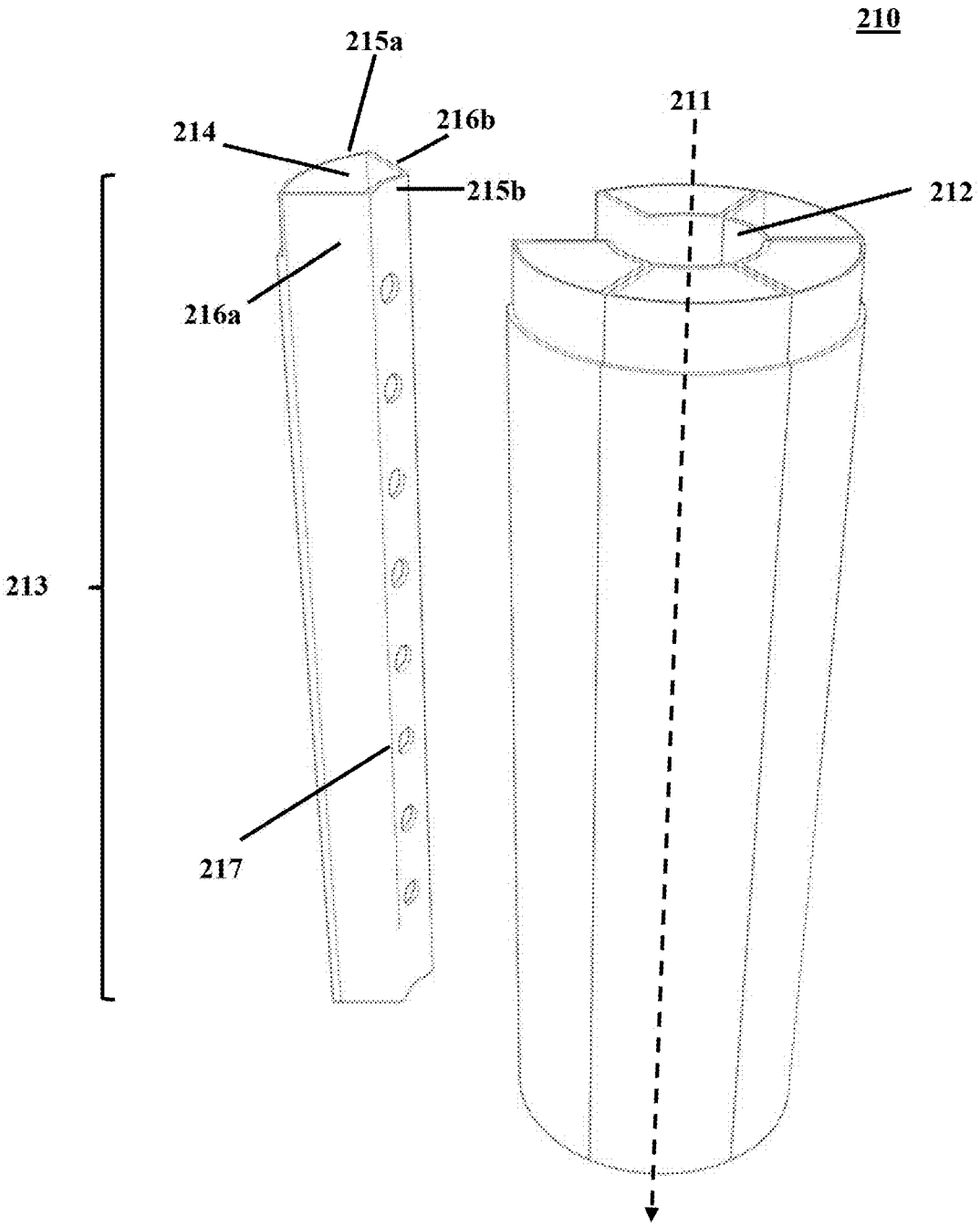
FIG. 3. Is an illustration of an exemplary combustible munition casing comprised of a plurality of wedge shaped elements.

FIG. 3 illustrates a cylindrical munition case 210 having a longitudinal axis 211 and a central hollow core 212 that runs along the longitudinal axis. The cylindrical munition tube is comprised of a plurality of wedge sections 213 that are fitted together to form an inner and outer wall surface of the rigid tube. Each wedge section 213 has a longitudinal cell cavity 214 surrounded by a set of parallel walls 215*a* and 215*b* and a set of non-parallel walls 216*a* and 216*b*. The set of parallel walls is composed of an outer parallel wall 215*a* and an inner parallel wall 215*b*. The non-parallel wall are perpendicular to the longitudinal axis of the central hollow core in an assembled munition tube. It is contemplated that a plurality of holes 217 may be positioned along the inner parallel wall 215*b*, to allow combustion gases to spread the flame into the propellant bed uniformly across the length of the cartridge. The munition tube is composed of a composite material such as felted fiber, foam celluloid, or polystyrene, and preferably foam celluloid. A plurality of wedge sections 213 can be assembled and fused together with heat, solvent or adhesives.

Each wedge section can be prepared in accordance with the methods described above. A plurality of wedges can be made using a single mold. The identical wedges can then be assembled together into a cylinder made from the repeating units.

Figure 4:
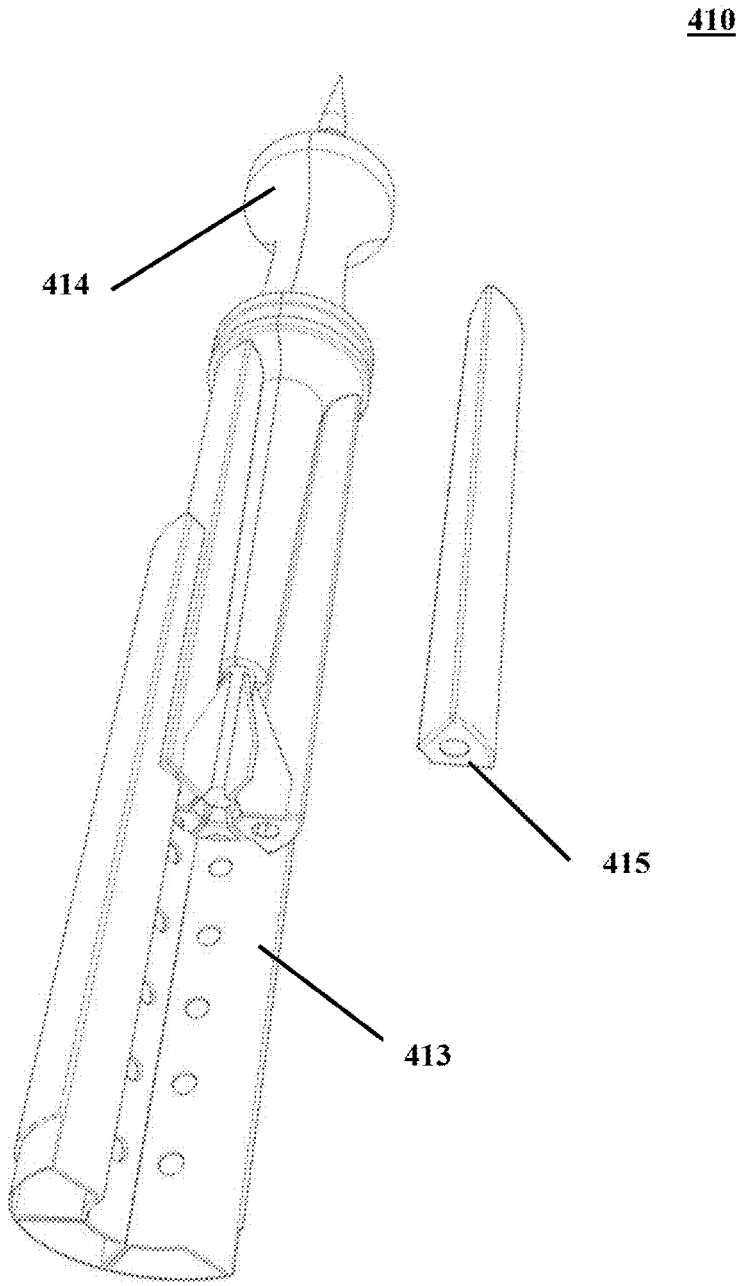
FIG. 4. Is an illustration of an exemplary combustible munition associated with a projectile.

FIG. 4 is an example of a partially assembled munition case 410 comprised of a plurality of wedge sections 413. An exemplary projectile 414 rests inside the munition case. A wedge section with a propellant 415 inserted into the longitudinal cavity is also illustrated here.

Example 3. Cartridge Case with Honeycomb Cavities

Figure 5:
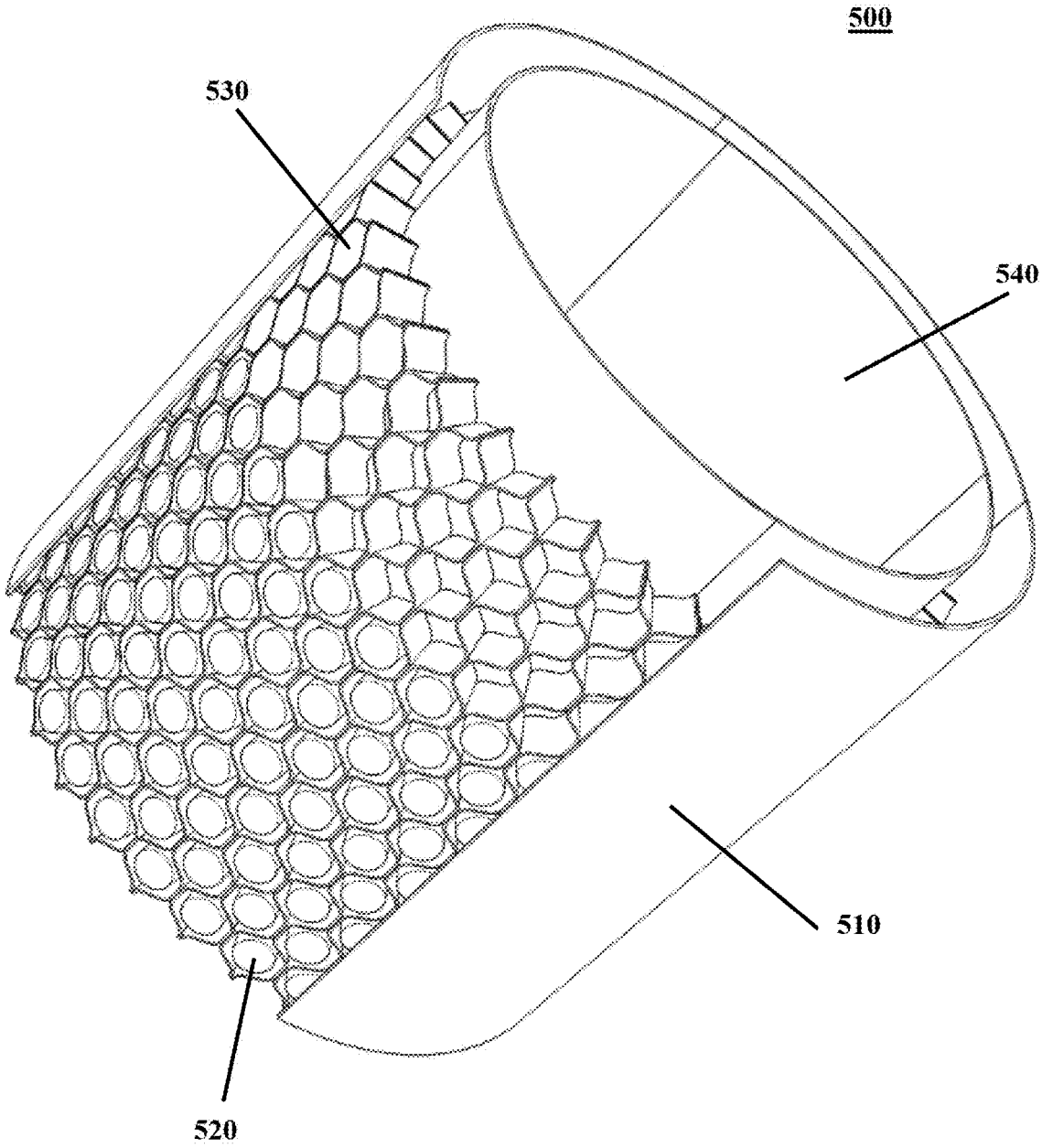
FIG. 5. Is an illustration of the inner and outer walls of the combustible munition having propellants placed inside the honeycomb-shaped cells.

FIG. 5 illustrates a cartridge case having honeycomb cell cavities. The case consists of two layers of combustible material (such as foam celluloid) with repeating cells shaped like honeycombs between the two layers that make up the inner 540 and outer wall 510 of the munition case. The cells can be filled with propellant 520 bonded in place. The honeycomb cells filled with propellant can mitigate the reduction in volume associated with composite cartridge casing walls. A plurality of vent holes (not illustrated) can be placed along the inner wall to allow combustion gases to spread the flame into the propellant bed uniformly across the length of the cartridge. Different types of propellants as described in FIG. 1*a* may be used. Expanding foam celluloid around propellant in the form of pellets can be utilized to fill the extra space between pellets and bond the surfaces together.

Testing Results

A honeycomb casing was prepared by presoaking celluloid beads in physical blowing agent (PBA) such as nitrogen, carbon dioxide, and or argon at about 40 to 10,000 psi, preferably 400-600 psi for about 10 mins to 24 hrs. The presoaked pellets are transferred into a mold cavity. The mold is heated using heating media such as steam, hot water, etc. Steam was used for this experimental trial. About 20-35 psi of steam was applied to heat the mold to 220-260° F. The mold is then cooled using water and air to 70° F. Each part is removed from the mold and assembled together into a munition casing having a central core and a cylindrical wall containing the honeycomb support structure situated between an inner and outer wall. A single walled, 155 mm, 58 caliber foam celluloid case (conventional single-wall case) was made using a similar process described above but without the honeycomb cell structure.

Both cartridge cases were then subject to bending, compression and drop tests. Finite element analysis was used to compare the increase in strength and stiffness of the honeycomb case compared to the conventional single-wall case. Three separate analyses were conducted to assess the improvement in: 1) bending stiffness and strength; 2) compression stiffness and strength; and 3) drop test survivability. The bending analysis predicts the structural response of the casings when they are loaded as a cantilever beam, and are displaced until failure of the material. The compression response is similarly predicted by displacing the casings in the axial direction until material failure. The drop test analysis predicts the structural response of the casings as a result of a drop from 2.13 meters (7 feet) while the axis of the casing is oriented at 45 degrees with respect to the ground. The drop test analysis yields a more qualitative result showing which configuration is damaged more as a result of the drop. The drop test analysis is also a good metric for predicting robustness and response to rough handling, transportation and vibratory loadings. For the drop-test, propellant was inserted into the central hollow core of both casings, however the honeycomb casing also contains propellant secured inside the cells. The extra propellant in the honeycomb cells were compensated by removing an equivalent volume of the propellant from the central core so that the total volume of propellant between the two designs are equivalent.

Table 1 below summarizes the results of these finite element analyses showing an improvement in all three areas for the honeycomb casing over the single wall casing.

TABLE 1

Comparison Testing of the Honeycomb cartridge casing and the Single-wall casing:

| Mechanical Test | Honeycomb vs Single wall |
|---|---|
| In bending: | 5× increase in strength compared to single wall casing |
| | 2× increase in stiffness compared to single wall casing |
| In compression: | 3× increase in strength compared to single wall casing |
| | 2× increase in stiffness compared to single wall casing |
| Drop Test | Honey-Comb, Mostly Intact |
| | Single-wall, Destroyed |

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

What is claimed is:

1. A rigid combustible munition case comprising:

a longitudinal axis, a central hollow core, and a plurality of separable wedge sections, wherein each of the plurality of separable wedge sections is comprised of a longitudinal cavity configured to receive propellant thereby providing structural strength to the separable wedge section, said longitudinal cavity being surrounded by a parallel set of walls and a non-parallel set of walls, wherein the parallel set of walls and the non-parallel set of walls run the entire length of the separable wedge section, and wherein the parallel set of walls run parallel to each other and form an outer wall portion and an inner wall portion of the munition case, said outer wall portion being an exterior wall of the munitions case, and the non-parallel set of walls are perpendicular to the longitudinal axis, and wherein the plurality of wedge sections are comprised of a consumable material.

2. The rigid combustible munition case of claim 1, wherein the inner wall portion is adjacent to the central hollow core and is comprised of a plurality of holes there along.

3. The rigid combustible munition case of claim 1, wherein the consumable material is foamed celluloid.

* * * * *